United States Patent [19]

Ogura et al.

[11] Patent Number: 4,750,015

[45] Date of Patent: Jun. 7, 1988

[54] WASTE TONER CONTAINER DETECTOR

[75] Inventors: Mitsuru Ogura, Nara; Kenji Okada, Yamatokoriyama, both of Japan

[73] Assignee: Sharp Kabushiki Kaisha, Osaka, Japan

[21] Appl. No.: 945,517

[22] Filed: Dec. 23, 1986

[30] Foreign Application Priority Data

Dec. 27, 1985 [JP] Japan ..... 60-297301

[51] Int. Cl.[4] ..... G03G 21/00

[52] U.S. Cl. ..... 355/3 DD; 355/15; 355/71

[58] Field of Search ..... 355/3 DD, 15, 71

[56] References Cited

U.S. PATENT DOCUMENTS 4,500,196 2/1985 Shimura ..... 355/3 DD

FOREIGN PATENT DOCUMENTS 0033647 8/1981 European Pat. Off. ..... 49/421

60-200277 10/1985 Japan ..... 355/15

OTHER PUBLICATIONS

Patent Abstracts of Japan, vol. 9, No. 259 (P-397), Oct. 17, 1985, Japanese Patent No. 60-108877.

Patent Abstracts of Japan, vol. 10, No. 60 (P-435), Mar. 11, 1986, Japanese Patent No. 60-202163.

*Primary Examiner*—Arthur T. Grimley

*Assistant Examiner*—J. Pendegrass

*Attorney, Agent, or Firm*—Birch, Stewart, Kolasch & Birch

[57] ABSTRACT

A detector mechanism for detecting the condition when a waste toner container is full of waste toner. A piston is provided which moves in response to the waste toner pressure in the waste toner container, a shutter is provided in the path of light irradiating the photoreceptor so as to close or open the light path, and a wire is provided which is connected between the piston and the shutter and forces the shutter to move in the direction for closing the light path according to the piston movement when the toner container is full of waste toner.

2 Claims, 3 Drawing Sheets

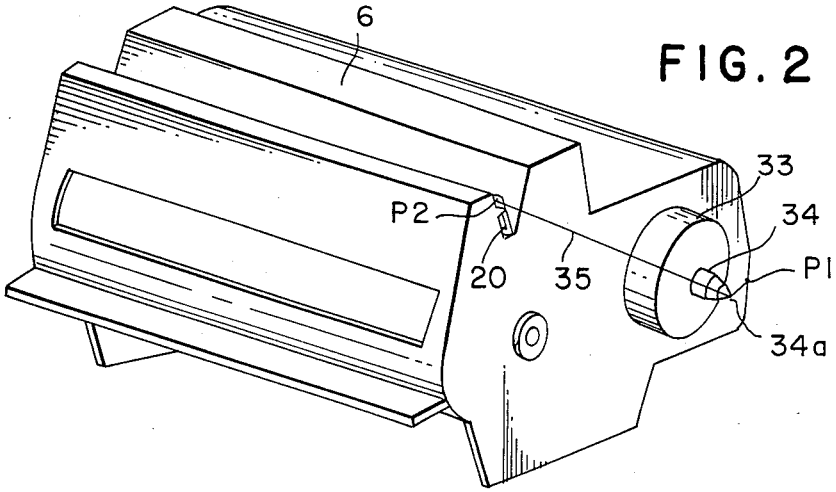
FIG. 2
FIG. 3
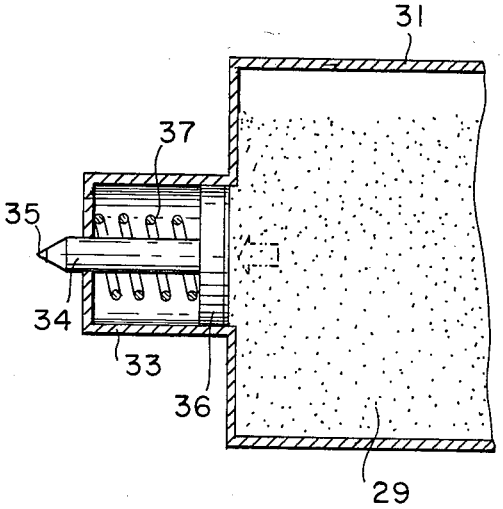

WASTE TONER CONTAINER DETECTOR

BACKGROUND OF THE INVENTION

The present invention relates to a waste toner container detector which detects when the container is full of waste toner collected from the photoreceptor.

Conventionally, a waste toner container is detected as being full by a weight sensor, a pressure sensor or an optical sensor provided in the waste toner container. Since the volume and weight of the waste toner tend to vary depending upon the waste toner density, however, detection by a weight or pressure sensor is not accurate. Detection by the optical sensor can also be inaccurate when the sensing surface of the sensor is soiled. In addition, any of the above waste toner container detectors is expensive.

SUMMARY OF THE INVENTION

The object of the present invention is to provide a waste toner container detector for detecting when the toner container is full and stopping the copying operation comprising a piston which moves in response to the waste toner pressure for easy and accurate detection of a full container, and a shutter provided in the path of a light which irradiates the photoreceptor which shutter closes the light path according to the piston movement thereby preventing an image from being copied when the container is full of waste toner.

The present invention comprises a piston moving in response to the waste toner pressure in the waste toner container, a shutter disposed in the path of light irradiating the photoreceptor so as to open or close the light path, and a wire connected between the piston and the shutter, forcing the shutter to shift in the direction for closing off the light path as the piston moves.

BRIEF DESCRIPTION OF THE DRAWINGS

The present invention will become more fully understood from the detailed description given hereinbelow and the accompanying drawings which are given by way of illustration only, and thus are not limitative of the present invention and wherein:

FIG. 2 is a perspective view of the cartridge of FIG. 1;

FIG. 3 shows a section of the rear end portion of the waste toner container of the cartridge.

DESCRIPTION OF THE PREFERRED EMBODIMENT

Figure 4:
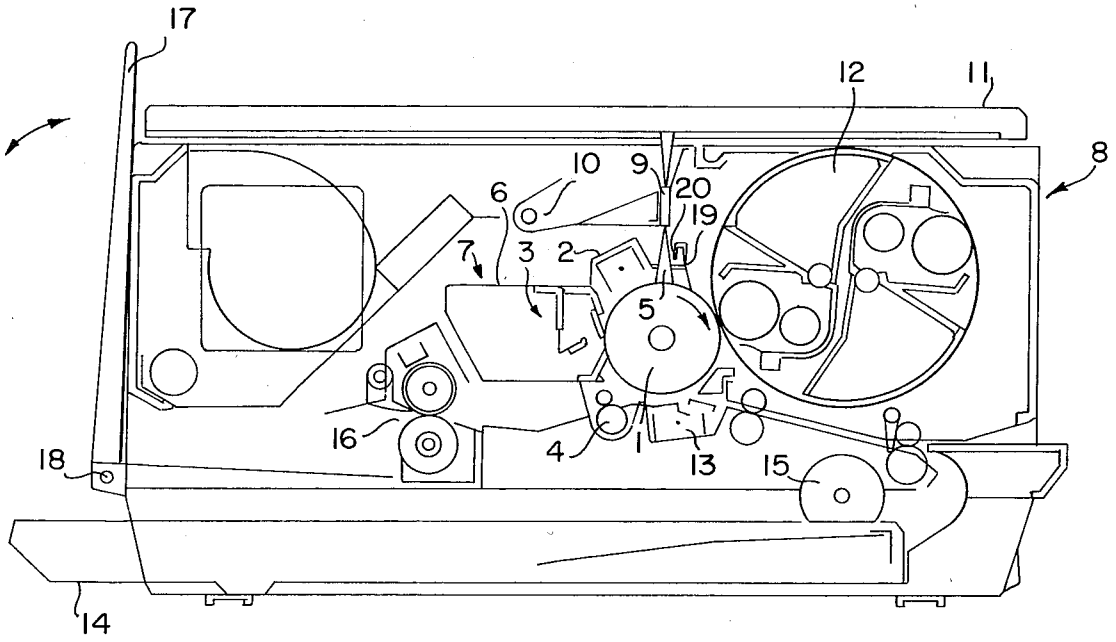
FIG. 4 is a schematic drawing of the copying machine.

FIG. 4 is a schematic construction drawing of a copying machine relating to the present invention. A photoreceptor 1 is mounted integrally with surrounding electric charger 2, cleaner unit 3, separator unit 4 and light exposure opening (slit) 5, in a housing 6, thus forming a cartridge 7. The cartridge 7 is detachable from the copying machine proper 8. The cartridge 7 can be set in the copying machine proper 8 simply by opening the front panel of the copying machine proper 8 and inserting the cartridge 7 vertical to a copy paper. The cartridge 7 can be dismounted by pulling it to the operator side. A rail guide mechanism (not shown) assists in mounting or dismounting the cartridge 7 in or from the copying machine proper 8.

A convergent light transmitter 9 mounted over the light exposure slit 5 and a light source 10 provided to the left of the transmitter 9 constitute an optical system. A document on a manuscript rest 11 is scanned by a light beam from the light source 10 as the manuscript rest 11 is moving horizontally. The light reflected by the document surface passes through the convergent light transmitter 9 for projection onto the photoreceptor 1 which is rotating in the direction of the arrow. The photoreceptor 1 is uniformly charged by the electric charger 2 before it is exposed to the light coming through the light exposure slit 5. An electrostatic image is formed and developed by a developing unit 12 and the developed image transferred onto a copy paper by a transference charger 13. The copy paper is fed from a copy paper cassette 14 by a paper feed roller 15 mounted at the bottom of the copying machine proper 8.

The copy paper, on to which the developed image has been transferred from the photoreceptor 1, is separated from the photoreceptor 1 by the separator unit 4 and conveyed to fixing rollers 16 where the image is fixed on the copy paper. Then, the copy paper is discharged onto a tray 17 which is rotatable about a pin 18 in the directions of the arrow. For the copying operation, the tray 17, which is folded as shown in FIG. 4, is rotated counterclockwise around the pin 18 and set in a position virtually parallel to the horizontal positioning of the copying machine proper 8. The developing unit 12 has two developing sections, either of which may be selected by rotation. A shutter 20 is rotatably held by a shutter support plate 19 in the light path between the light exposure slit 5 and the convergent light transmitter 9. As will be described below, an end of a wire and a spring are connected to the shutter 20. The wire, receiving tension proportional to the waste toner pressure in the container, imparts a rotational torque to the shutter 20 against the force of the spring. At a certain level of tension applied to the wire, the shutter 20 is made to rotate suddenly, closing the light path between the light exposure slit 5 and the convergent light transmitter 9.

Figure 1:
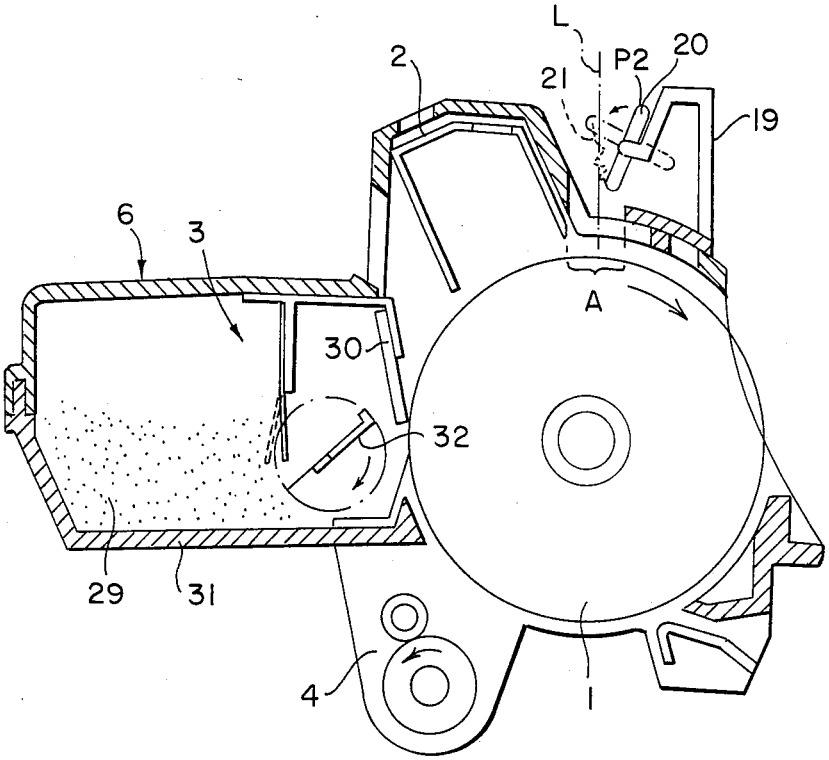
FIG. 1 is a sectional view of a cartridge including a photoreceptor of a copying machine of which the waste toner container of an embodiment of the present invention is a part.

FIG. 1 is a sectional view of the cartridge 7. The rotary shaft of the photoreceptor 1, the electric charger 2, the cleaner unit 3 and the separator unit 4 are mounted in the housing 6. The housing 6 has an opening at the portion facing the exposure area "A" of the photoreceptor 1, which opening defines the light exposure slit 5. The shutter support plate 19 is provided above the light exposure slit 5 and rotatably supports the shutter 20. The spring 21 is connected between the housing 6 and an end of the shutter 20. An end of a wire is also engaged with the shutter 20 as described later.

The cleaner unit 3 comprises a blade 30 for scraping off the toner remaining on the photoreceptor 1 as waste toner, the waste toner container 31, and a rotary plate 32 which rotates in the direction of the arrow to direct the waste toner into the waste toner container 31.

FIG. 2 is a perspective view of the rear of the cartridge 7. As shown, the container 6 has a projection 33 at its rear end. The projection 33 has a center hole through which a piston 34 is passed. The piston 34 is tapered at its end portion and has a groove 34*a* in the end. The wire 35 is slidably supported in the groove 34*a*, with an end connected at the point P1 of the housing 6 and the other end at the point P2. As shown in FIG. 1, the point P2 engaged with the other end of the wire 35 is located in the upper part of the shutter 20 and conforms at the point to which the spring 20 is connected.

FIG. 3 shows a section of the projection 33. As shown, the piston 34 is mounted on a slide 36 slidable in the projection 33. In the projection 33, a spring 37 is provided between the slide 36 and the inner wall of the projection 33. The opposite side of the slide 36 is positioned to be in contact with the waste toner 29 in the container 31. As the waste toner pressure in the container 31 increases, the waste toner pressure is applied in the direction indicated by the arrow of FIG. 3 against the slide 36, causing the slide 36 to move toward the left against the force of the spring 37. Operation of the full waste toner container detector is described now. The waste toner pressure is applied in the direction indicated by the arrow of FIG. 3 against the slide 36 accordingly as the amount of the waste toner 29 increases and, therefore, its pressure increases. The slide 36 moves toward the left, against the force of the spring 37, pushing the piston 34 outwardly. Tension starts to be generated in the wire 35 as the piston is projected outwardly. In the normal state as shown in FIG. 1, the shutter 20 is positioned as indicated by the solid line, leaving the light path "L" open. When the tension of the wire 35 exceeds a certain level, the shutter 20 is suddenly rotated counterclockwise by the force of the spring 21 and stops at the position indicated by chain double-dashed line in FIG. 1. In this state, since the light path "L" is closed by the shutter 20, light cannot be irradiated on the exposed area "A" of the photoreceptor.

As mentioned above, when the pressure of the waste toner 29 in the container 31 exceeds a certain level, the shutter 20 is rotated suddenly by means of the piston 34 and the wire 35, thus closing the light path "L". This operation is achieved regardless of the weight and density of the waste toner in the container 31. Therefore, the light path "L" is closed accurately when the waste toner container 31 is full, with no room for further waste toner.

In the above embodiment of the invention, the spring 21 is connected to the shutter 20, permitting the shutter 20 to close the light path suddenly under the specified condition. The invention need not include the spring 21. According to the present invention in which the piston 34, wire 35 and shutter 20 are integrally mounted in the cartridge 7, when the shutter 20 has closed the light path "L" due to the full condition of the waste toner container, the only thing to be done is to replace the cartridge 7 with a new one; the replacement operation is easy enough to be carried out by the user without any special help of service staff.

According to the present invention, since the piston moves responsive to the waste toner pressure in the container, it never happens that the detector determines the container is full when it is not or vice versa.

Due to the wire forcing the shutter to move in the direction for closing the light path according to the piston movement, the shutter closes the light path when the waste toner pressure in the container increases to a specified level, that is, when the container has been filled up with waste toner. In other words, the detector of the present invention inhibits further image forming when the container has been filled, preventing waste toner from flowing over the container and soiling the interior of the image forming apparatus.

While only certain embodiments of the present invention have been described, it will be apparent to those skilled in the art that various changes and modifications may be made therein without departing from the spirit and scope of the present invention as claimed.

What is claimed is:

1. A waste toner container detector mechanism for detecting when the waste toner container is full and stopping further copying of a copying machine comprising:

a piston mounted in a waste toner container for storing waste toner particles collected from a photoreceptor surface, said piston moving in response to pressure exerted by said waste toner in said waste toner container;

a shutter provided so as to be able to close or open a light path for exposing said photoreceptor; and a wire connected between said piston and said shutter, such that said wire causes said shutter to move in a direction for closing said light path in response to said piston movement.

2. The waste toner detector mechanism of claim 1, further including a biasing spring connected to said shutter conforming to the point of connection of said wire.

* * * * *